US005811178A

United States Patent [19]

Adam et al.

[11] Patent Number: 5,811,178

[45] Date of Patent: Sep. 22, 1998

[54] HIGH BULK NONWOVEN SORBENT WITH FIBER DENSITY GRADIENT

[75] Inventors: Gabriel Haman Adam, Roswell; Bryan David Haynes, Cumming; Jark Chong Lau, Roswell; Jeffrey Lawrence McManus, Canton, all of Ga.

[73] Assignee: Kimberly-Clark Worldwide, Inc., Neenah, Wis.

[21] Appl. No.: 749,597

[22] Filed: Nov. 15, 1996

Related U.S. Application Data

[63] Continuation-in-part of Ser. No. 528,829, Sep. 15, 1995, Pat. No. 5,652,048, which is a continuation-in-part of Ser. No. 510,354, Aug. 2, 1995.

[51] Int. Cl.[6] ..... B32B 7/02

[52] U.S. Cl. ..... 428/218; 210/502.1; 210/922; 428/903; 442/351; 442/400

[58] Field of Search ..... 428/218, 903; 442/351, 400; 210/502.1, 922

[56] References Cited

U.S. PATENT DOCUMENTS

| | | | |
|---|---|---|---|
| Re. 31,087 | 11/1982 | Sohl | 210/671 |
| Re. 31,885 | 5/1985 | Meitner | 252/91 |
| 1,856,401 | 5/1932 | Prince . | |
| 2,065,124 | 12/1936 | Dreyfus et al. | 18/8 |
| 2,574,221 | 11/1951 | Modigliani | 154/80 |
| 2,954,271 | 9/1960 | Cenzato | 18/54 |
| 2,982,310 | 5/1961 | West | 137/793 |
| 3,061,401 | 10/1962 | Studer et al. | 18/54 |
| 3,110,059 | 11/1963 | Tallis et al. | 18/8 |
| 3,207,587 | 9/1965 | Fulk | 65/5 |
| 3,282,668 | 11/1966 | Mabru | 65/12 |
| 3,436,792 | 4/1969 | Hench | 18/8 |
| 3,438,104 | 4/1969 | Stoller | 28/72 |
| 3,442,633 | 5/1969 | Perry | 65/3 |
| 3,444,587 | 5/1969 | Polovets et al. | 18/8 |

(List continued on next page.)

FOREIGN PATENT DOCUMENTS

| | | |
|---|---|---|
| 1308528 | 9/1962 | France . |
| 1373768 | 8/1963 | France . |
| 2217459 | 9/1974 | France . |
| 2302928 | 7/1974 | Germany . |
| 4014989 | 1/1991 | Germany . |
| 4014-413-A | 11/1991 | Germany . |
| 47-00090 | 11/1969 | Japan . |
| 46-34373 | 10/1971 | Japan . |
| 47-9527 | 3/1972 | Japan . |
| 47-32136 | 8/1972 | Japan . |
| 48-380025 | 11/1973 | Japan . |
| 52-5631 | 2/1977 | Japan . |
| WO 86/04936 | 8/1986 | Japan . |

(List continued on next page.)

OTHER PUBLICATIONS

"Melt Blowing: General Equation Development and Experimental Verification," Marc A. J. Uyttendaele and Robert L. Shambaugh, *AlChE Journal*, Feb. 1990, Vol. 36 No. 2, pp. 175–186.

"The Manufacture of Continuous Polymeric Filaments by the Melt–Blowing Process", John C. Kayser and Robert L. Shambaugh, *Polymer Engineering and Science*, Mid–Oct. 1990, vol. 30, No. 19, pp. 1237–1251.

"A Macroscopic View of the Melt–Blowing Process for Producing Microfibers," Robert L. Schambaugh,*I&CE Research*, 1988, 27.2363, pp. 2363–2372.

*Primary Examiner*—James J. Bell
*Attorney, Agent, or Firm*—William D. Herrick

[57] ABSTRACT

Disclosed is an improved high sorbency nonwoven fabric and its use particularly as an oilsorb material. The high sorbency nonwoven is preferably made by multi-bank melt-blowing and different perturbing thermoplastic fibers of, for example, propylene polymers in separate banks to provide a fiber density gradient through the thickness of the fabric. The sorbent nonwovens have high bulk and strength, oil capacity and oil absorption rates making them particularly suited to such applications. Treatments and additives for such materials are also disclosed.

19 Claims, 12 Drawing Sheets

U.S. PATENT DOCUMENTS

| | | | |
|---|---|---|---|
| 3,509,009 | 4/1970 | Hartmann | 161/150 |
| 3,568,716 | 3/1971 | Heitzman | 137/624.14 |
| 3,616,037 | 10/1971 | Burger | 156/303 |
| 3,663,206 | 5/1972 | Lubanska | 75/60 |
| 3,682,734 | 8/1972 | Burger | 156/166 |
| 3,802,037 | 4/1974 | Sakai | 28/72.1 |
| 3,802,817 | 4/1974 | Matsuki et al. | 425/66 |
| 3,825,379 | 7/1974 | Lohkamp et al. | 425/72 |
| 3,825,380 | 7/1974 | Harding et al. | 425/72 |
| 3,849,241 | 11/1974 | Butin et al. | 161/169 |
| 3,920,362 | 11/1975 | Bradt | 425/72 |
| 3,954,361 | 5/1976 | Page | 425/72 S |
| 3,959,421 | 5/1976 | Weber et al. | 264/6 |
| 3,967,118 | 6/1976 | Sternberg | 250/325 |
| 3,970,417 | 7/1976 | Page | 425/72 S |
| 3,999,909 | 12/1976 | Schippers | 425/72 S |
| 4,003,774 | 1/1977 | Lebet et al. | 156/180 |
| 4,015,963 | 4/1977 | Levecque et al. | 65/5 |
| 4,058,960 | 11/1977 | Movschovich et al. | 57/34 AT |
| 4,070,218 | 1/1978 | Weber | 156/167 |
| 4,100,324 | 7/1978 | Anderson et al. | 428/288 |
| 4,102,662 | 7/1978 | Levecque et al. | 65/5 |
| 4,113,456 | 9/1978 | Levecque et al. | 65/5 |
| 4,118,213 | 10/1978 | Levecque et al. | 65/5 |
| 4,123,243 | 10/1978 | Levecque et al. | 65/16 |
| 4,137,059 | 1/1979 | Levecque et al. | 65/5 |
| 4,146,378 | 3/1979 | Levecque et al. | 65/5 |
| 4,159,199 | 6/1979 | Levecque et al. | 65/5 |
| 4,185,981 | 1/1980 | Ohsato et al. | 65/5 |
| 4,211,737 | 7/1980 | Di Drusco et al. | 264/12 |
| 4,285,452 | 8/1981 | Reba et al. | 226/7 |
| 4,316,731 | 2/1982 | Lin et al. | 65/5 |
| 4,374,888 | 2/1983 | Bomslaeger | 428/198 |
| 4,380,570 | 4/1983 | Schwarz | 428/296 |
| 4,444,961 | 4/1984 | Timm | 526/88 |
| 4,472,329 | 9/1984 | Muschelknautz et al. | 264/12 |
| 4,478,248 | 10/1984 | DeVall et al. | 137/624.13 |
| 4,526,733 | 7/1985 | Lau | 264/12 |
| 4,622,259 | 11/1986 | McAmish et al. | 428/171 |
| 4,623,706 | 11/1986 | Timm et al. | 526/88 |
| 4,643,215 | 2/1987 | Phlipot | 137/15 |
| 4,666,673 | 5/1987 | Timm | 422/135 |
| 4,692,106 | 9/1987 | Grabowski et al. | 425/66 |
| 4,787,417 | 11/1988 | Windsor, Jr. | 137/624.13 |
| 4,818,463 | 4/1989 | Buehning | 264/40.1 |
| 4,818,464 | 4/1989 | Lau | 264/510 |
| 4,818,466 | 4/1989 | Mente et al. | 264/555 |
| 4,820,142 | 4/1989 | Balk | 425/66 |
| 4,847,035 | 7/1989 | Mente et al. | 264/555 |
| 4,992,124 | 2/1991 | Kurihara et al. | 156/161 |
| 5,057,361 | 10/1991 | Sayovitz et al. | 428/290 |
| 5,075,068 | 12/1991 | Milligan et al. | 264/555 |
| 5,080,569 | 1/1992 | Gubernick et al. | 425/7 |
| 5,087,186 | 2/1992 | Buehning | 425/72.2 |
| 5,098,636 | 3/1992 | Balk | 264/555 |
| 5,143,121 | 9/1992 | Steinhardt et al. | 137/624.13 |
| 5,148,946 | 9/1992 | Mizuta et al. | 222/1 |
| 5,160,746 | 11/1992 | Dodge, II et al. | 425/7 |
| 5,164,198 | 11/1992 | Bauckhage et al. | 425/6 |
| 5,196,207 | 3/1993 | Koenig | 425/72.2 |
| 5,242,150 | 9/1993 | Shiffler et al. | 251/209 |
| 5,244,607 | 9/1993 | Rheutan, Jr. et al. | 264/23 |
| 5,244,723 | 9/1993 | Anderson et al. | 428/283 |
| 5,248,455 | 9/1993 | Joseph et al. | 264/6 |
| 5,262,110 | 11/1993 | Spaller, Jr. et al. | 264/207 |
| 5,312,500 | 5/1994 | Kurihara et al. | 156/62.4 |
| 5,353,838 | 10/1994 | Grant | 137/642.13 |
| 5,364,680 | 11/1994 | Cotton | 428/126 |
| 5,405,559 | 4/1995 | Shambaugh | 364/6 |
| 5,435,708 | 7/1995 | Kaun | 425/72.2 |

FOREIGN PATENT DOCUMENTS

| | | |
|---|---|---|
| 5-195309 | 8/1993 | Japan . |
| 533304 | 2/1941 | United Kingdom . |
| 749779 | 5/1956 | United Kingdom . |
| 1157695 | 7/1969 | United Kingdom . |
| 1219921 | 1/1971 | United Kingdom . |

EFFECT OF PERTURBATION FREQUENCY ON FRAZIER POROSITY.

HIGH BULK NONWOVEN SORBENT WITH FIBER DENSITY GRADIENT

This application is a continuation-in-part of application Ser. No. 08/528,829, entitled "HIGH BULK NONWOVEN SORBENT" and filed in the U.S. Patent and Trademark Office on Sep. 15, 1995 now U.S. Pat. No. 5,652,048 which is a continuation-in-part of application Ser. No. 08/510,354, entitled "APPARATUS FOR THE PRODUCTION OF FIBERS AND MATERIALS HAVING ENHANCED CHARACTERISTICS" and filed in the U.S. Patent and Trademark Office on Aug. 2, 1995 now pending. The entirety of these applications is hereby incorporated by reference.

FIELD OF THE INVENTION

This invention relates generally to the production of nonwoven fabrics, and particularly, to the field of production of nonwoven fabrics with controlled fiber density concentrations having desirable bulk and sorbency properties using melt-blown and coform techniques. Such nonwovens find particular use in oilsorb applications.

BACKGROUND OF THE INVENTION

The production of nonwoven fabrics has long used melt-blown, coform and other techniques to produce webs for use in forming a wide variety of products. As used herein the term "meltblown fibers" means fibers formed by extruding a molten thermoplastic material through a plurality of fine, usually circular, die capillaries as molten threads or filaments into converging high velocity, usually heated, gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Butin. Meltblown fibers are microfibers which may be continuous or discontinuous, are generally smaller than 20 and preferably less than 10 microns in average diameter, and are generally selfbonded when deposited onto a collecting surface.

It is well known in the art to vary a number of processing parameters in melt-blown fiber forming processes to obtain fibers of desired properties in order to form fabrics with desired characteristics. However, the majority of prior art techniques for varying fiber characteristics require more time consuming changes in machinery or process, such as changing dies or changing the resins. Therefore, those techniques may require that the production line be halted while the necessary changes are made, which results in inefficiency when a new material is to be run.

The prior art has previously taught that various effects can be obtained by the manipulation of air flow near the fiber exit in melt-blown fiber producing equipment. For example, Shambaugh, U.S. Pat. No. 5,405,559, teaches that the air flow provided in the melt-blown process can be alternately turned on and off on both sides of the die, thus reducing the energy required to produce melt-blown fibers. However, this teaching of Shambaugh has several drawbacks. Under some conditions, the complete shutting off of the air on either side will tend to blow the liquefied resin onto the air plates on the other side of the die, thereby clogging the machinery for typical production airflow rates (especially with high MFR polymers or other polymers normally used in non-woven web production). Further, such techniques would likely result in the deposition of resin globs or "shot" on the production web since the resin would be affected only minimally during the transition from airflow on one side of the die to the other. Finally, while the Shambaugh reference teaches switching air on and off for the purposes of reducing fiber size for a given flow, its main emphasis is that such switching saves energy by reducing the overall airflow requirements in the melt-blown process. Moreover, the low frequencies taught by Shambaugh would result in poor formation on a high speed machine. Fibers produced as given in the examples are coarser, e.g. larger diameters than typically found in non-woven commercial production.

U.S. Pat. No. 5,075,068, teaches the use of a steady state shearing air stream near the exit of the die in the melt-blown process for the purpose of increased drag on fibers exiting the die. The steady state air stream therefore draws the fibers further and enhances the quenching of the fibers. However, this patent teaches a steady state airflow airflow characteristics for varying fiber parameters in a spunbond fiber for producing a better fiber, but does not teach that airflow characteristics may be selectively altered to vary the characteristics of fibers in a desired manner.

Finally, U.S. Pat. No. 5,312,500, teaches alternating airflows at the exit of a spunbond fiber draw unit for laying a continuous fiber down in an elliptical fashion to form a non-woven web. This patent teaches that, among other techniques, varying airflows may direct fibers onto a foraminous forming surface to form a non-woven web. By varying the manner in which the fibers are deposited using airflow variation, this reference states that the characteristics of the web may be enhanced. However, this reference does not teach that the airflows may be used to enhance or vary the characteristics of the fibers themselves.

Therefore, it is an object of the present invention to provide highly sorbent meltblown and coform non-woven webs having desired characteristics through the production of fibers using perturbed airflows of varying characteristics during fiber formation.

It is yet another object of the present invention to provide a process and apparatus for the formation of fibers and nonwovens having specific, desired characteristics by the simple, selective variation of the frequency and/or amplitude of perturbation of air flow for multiple forming means during the production of the fibers.

SUMMARY OF THE INVENTION

The above and further objects are realized in a process and apparatus for the production of highly sorbent meltblown and coform nonwovens in accordance with disclosed and preferred embodiments of the present invention as well as in the resulting sorbent products for absorbing oil and other uses. Bulk of these materials in terms of density is generally within the range of up to about 0.1 g/cc, preferably up to about 0.06 g/cc.

Generally, the present invention relates to improvements to apparatus for forming highly sorbent meltblown and coform nonwovens and resulting sorbent materials and products. The apparatus may include multiple known melt-blowing means for generating a substantially continuous airstream for capturing fibers along a primary axis, at least a first extrusion die located next to the airstream for extruding the liquefied resin, and perturbation means for selectively perturbing the air stream by varying the air pressure on either side or both sides of the primary axis of at least one of the multiple meltblowing means. The apparatus may also include a moving foraminous forming wire disposed below the first die wherein the entrained fibers are deposited on the substrate to form a highly sorbent non-woven web having controlled fiber density through the cross-section of the web from one surface to the other surface.

The meltblowing or coforming apparatus may include in each case a first supply of air connected to first and second air plenum chambers located on opposite sides of the axis, wherein plenum chambers' outlets provide a substantially continuous air stream for fiber attenuation. The perturbation means may include a valve for selectively varying the airflow rate to the first and second plenums, thereby producing air induced perturbation to the entrained fibers. Additionally, airstream perturbation may be achieved by superimposing a perturbed secondary air supply on the first air supply within the plenum chambers. Alternatively, the perturbation means may include first and second pressure transducers adjacent or attached to the first and second plenum chambers, and means for selective activation of the first and second pressure transducers for selectively varying the pressure in the first and second plenum chambers. Generally, the perturbation means varies a steady state pressure in the first and second plenum chambers at a perturbation frequency of, for example, less than 1000 Hertz, and varies an average plenum pressure in the first and second plenum chambers, for example, up to about 100% of the total average plenum pressure in the absence of activation of the perturbation means.

As stated above, meltblown webs are often selfbonded and require no additional bonding to provide adequate strength for most sorption applications. However, if desired, bonding may be supplemented by any of the known means for bonding nonwovens so long as the desirable bulk and sorption properties are not adversely affected to the point that the material is not suited to its intended use. For example, heavier basis weight materials may be point bonded by the application of heat and pressure in a widely spaced pattern over a low per cent of the surface area. Other bonding means such as adhesives, for example, may be similarly employed.

The basis weight of high bulk sorbent webs in accordance with the invention will vary widely depending on the intended use from relatively lightweight oil wipes and drip pads to heavy mats for treating oil spills. For many applications the basis weight will be within the range of from about 15 grams per square meter (gsm) to 1000 gsm with most oil sorbents within the range of from about 30 gsm to about 450 gsm.

Polymers useful in accordance with the invention for oilsorb materials include those thermoplastics that are or which may be made oleophilic, for example, polyolefins such as polypropylene, polyethylene, and blends and copolymers alone or in admixture with other fibers. Preferred polymers are hydrophobic when it is desire to avoid absorption of water in use. In addition, perturbation facilitates the use of reclaim in the process and often permits higher levels, for example up to 40%, of reclaim material to be used for improved economics.

DETAILED DESCRIPTION OF THE PREFERRED EMBODIMENTS

Figure 1A:
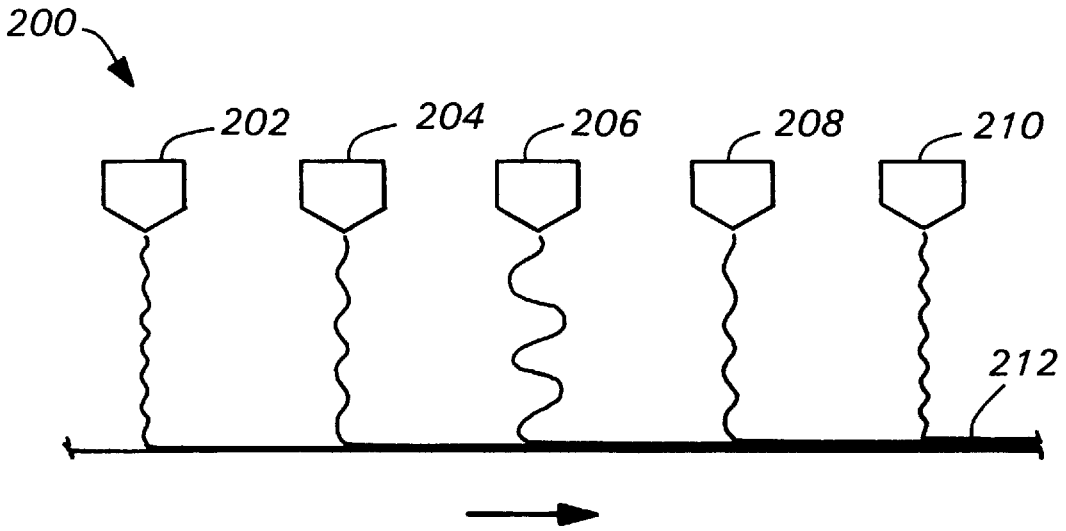
FIGS. 1*a* and 1*b*, respectively, illustrate generally an arrangement of meltblowing devices with varying perturbations and a resulting highly sorbent material cross-section.

The following techniques are applicable to the melt-blown and coform fiber forming processes for making highly sorbent nonwovens in accordance with the invention. For the sake of clarity, the general principles of the invention will be discussed with reference to these techniques. Following the general description of the techniques, the specific application of these techniques in the melt-blown and coform fields will be described. For ease in following the discussion, sub-headings are provided below; however, these sub-heading are for the sake of clarity and should not be considered as limiting the scope of the invention as defined in the claims. As used herein, the term "perturbation" means a small to moderate change from the steady flow of fluid, or the like, for example up to 50% of the steady flow, and not having a discontinuous flow to one side. Furthermore, as used herein, the term "fluid" shall mean any liquid or gaseous medium; however, in general the preferred fluid is a gas and more particularly air. Additionally, as used herein the term "resin" refers to any type of liquid or material which may be liquefied to form fibers or non-woven webs, including without limitation, polymers, copolymers, thermoplastic resins, waxes and emulsions.

As was described previously, the production of fibers having various characteristics has been known in the prior art. However, the preferred embodiments of the present invention provide for a much greater range of variation in fiber characteristics within a nonwoven web and provide for a greater range of control of such variations. These techniques allow one to "tune in" the characteristics of the non-woven web formed thereby with little or no interruption of the production process. The basic technique involves perturbing the air used to draw the fiber from the die in one or more banks of meltblowing devices in a multi-bank forming line. Preferably, the airflow in which the fiber travels is alternately perturbed on opposite sides of an axis parallel to the direction of travel of the fiber. Thus, the airstream carrying the forming fiber is perturbed, resulting in perturbation of the fiber during formation. Airstream perturbation according to the methods and apparatus of the present invention may be implemented in melt-blown and coforming processes, but is not limited to those processes. In accordance with the invention, the perturbation degree is different for different banks producing a fiber density variation within the resulting web cross-section.

In general, the airflow may be perturbed in a variety of ways; however, regardless of the method used to perturb the airflow, the perturbations have two basic characteristics, frequency and amplitude. The perturbation frequency may be defined as the number of pulses provided per unit time to either side. As is common, the frequency will be described in Hertz (number of cycles per second) throughout the specification. The amplitude may also be described by the percentage increase or difference in air pressure $(\Delta P/P)\times 100$ in the perturbed stream as compared to the steady state. Additionally, the perturbation amplitude may be described as the percentage increase or difference in the air flow rate during perturbation as compared to the steady state. Thus, the primary variables which may be controlled by the new fiber forming techniques are perturbation frequency and perturbation amplitude. The techniques described below easily control these variables. A final variable which may be changed is the phase of the perturbation. For the most part, a 180° phase differential in perturbation is described below (that is, a portion of the airflow on one side of an axis parallel to the direction of flow is perturbed and then the other side is alternately perturbed); however, the phase differential could be adjusted between 0° to 180° to achieve any desired result. Tests have been conducted with the perturbation being symmetric (in phase) and with varying phase relationships. This variation allows for still more control over the fibers made thereby and the resulting web or material.

The perturbation of the air stream and fibers during formation has several positive effects on the fiber formed thereby. First, the particular characteristics of the fiber such as strength and crimp may be adjusted by variation of the perturbation. Thus, in non-woven web materials, increased bulk and tensile strength may be obtained by selecting the proper perturbation frequency and amplitude. Increased crimp in the fiber contributes to increased bulk in the non-woven web, since crimped fibers tend to take up more space. In accordance with the present invention this increased bulk and other web properties can be controlled to result in a highly sorbent meltblown or coform nonwoven having particular utility, for example, as an oil sorbent for cleaning or restricting oil spills. Additionally, preliminary investigation of the characteristics of meltblown fibers made in accordance with the present invention, as compared to those made with prior art techniques, appear to indicate that fibers made in accordance with the present invention exhibit different crystalline and heat transfer characteristics. It is believed that such differences are due to heat transfer effects (including quenching) which result from the movement of fibers in a turbulent airflow. It is further believed that such differences contribute to the enhanced characteristics of fibers and non-woven materials made in accordance with the techniques of the present invention. Additionally, the perturbation of the airflow also results in improved deposition of the fibers on the forming substrate, which enhances the strength, uniformity and other properties of the web formed thereby.

Furthermore, since the variables of frequency and amplitude of the perturbation are easily controlled, fibers of different characteristics may be made by changing the frequency and/or amplitude. Thus, it is possible to change the character of the non-woven web being formed during processing (or "on the fly"). By this type of adjustment, a single machine may manufacture non-woven web fabrics having different characteristics required by different product specification while eliminating or reducing the need for major hardware or process changes, as is discussed above. Additionally, the present invention does not preclude the use of conventional process control techniques to adjust the fiber characteristics.

Figure 2:
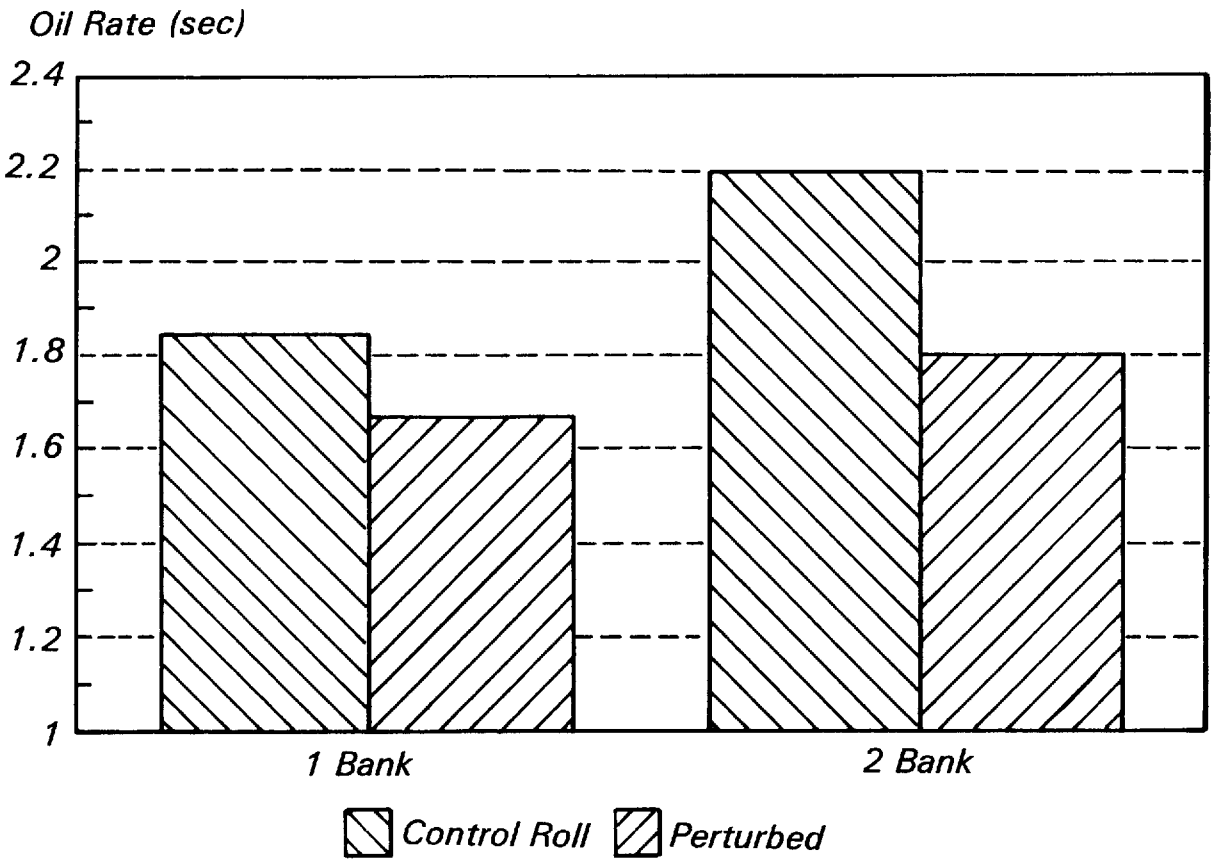
FIG. 2 is a graph illustrating oil absorption rate results obtained in accordance with the present invention.
Figure 3:
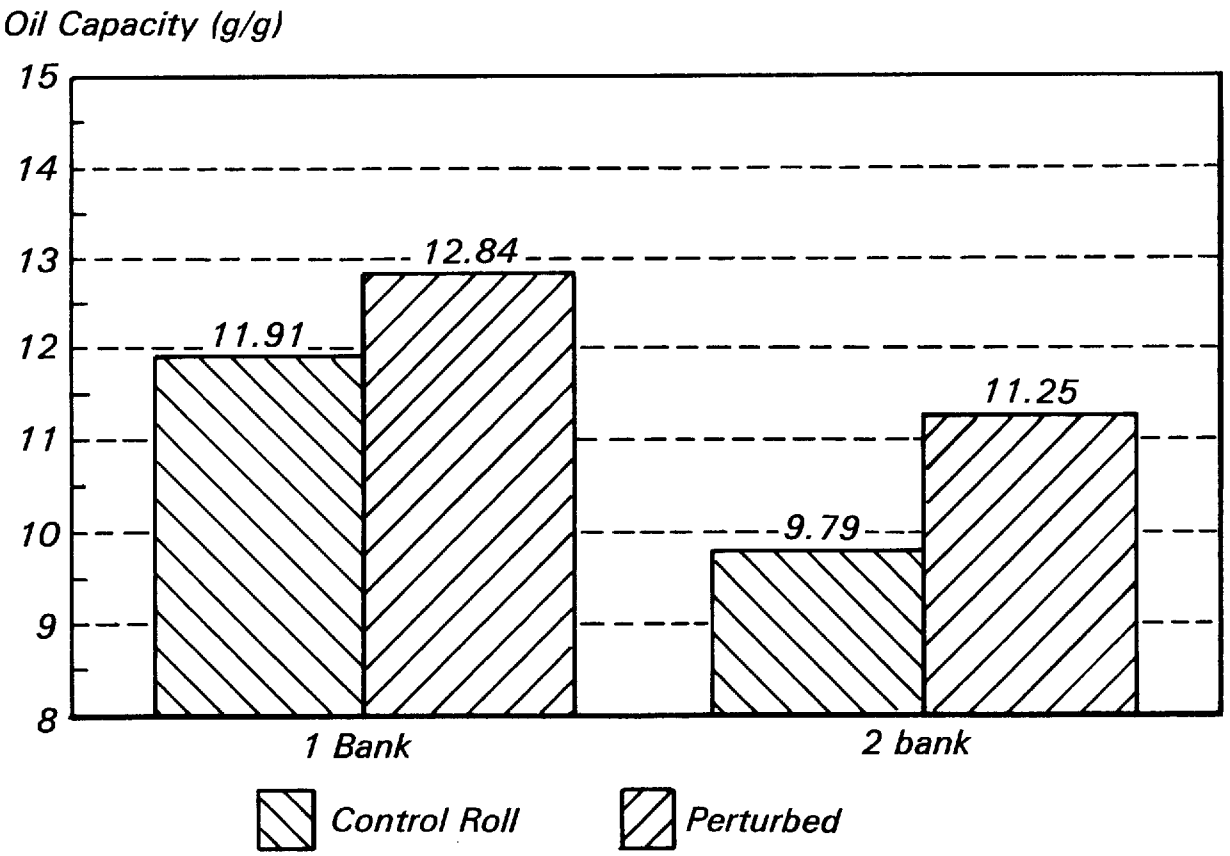
FIG. 3 is a similar graph of oil capacity results.

Referring now to FIGS. 2 and 3, oil sorbency results are illustrated comparing an unperturbed control meltblown (Examples 2A and 2I below) and perturbed meltblown (Examples 2B and 2H below). As shown, significant increases in both rate and capacity are obtained in each case for one bank and two bank operation. The fibers in the web made in accordance with the perturbation techniques of the present invention are much more crimped and are not predominantly aligned in the same direction resulting in substantially increased bulk or thickness. Thus, as will be seen in the results described below, webs made in accordance with the present invention tend to exhibit greater bulk for a given weight and frequently have greater machine and cross direction strengths (the machine direction is the direction of movement, relative to the forming die, of the substrate on which the web is formed; the cross direction is perpendicular to the machine direction). It is believed that the increase crimp will provide many more points of contact for the fibers of the web which will enhance web strength.

Figure 1B:
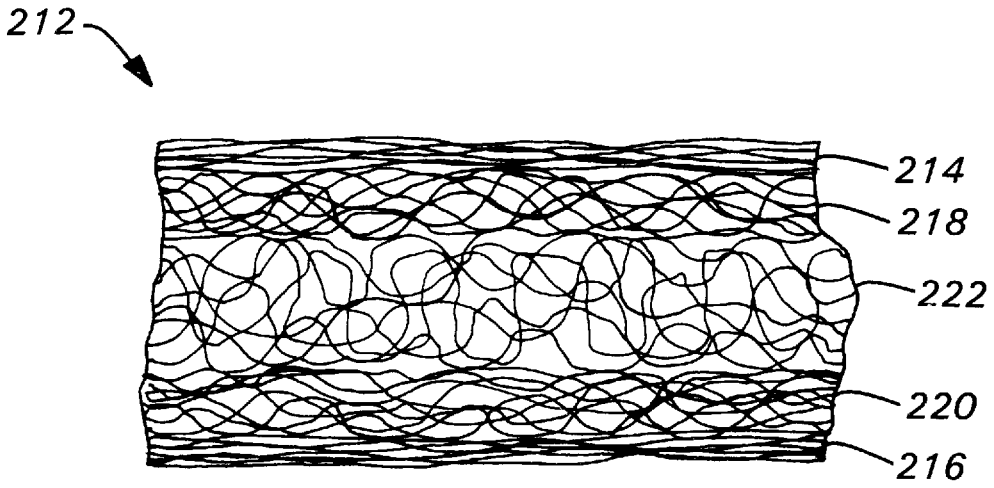

Referring to FIGS. 1(*a*) and 1(*b*), even greater improvements in properties, especially for oil may be obtained in accordance with the invention when a composite fabric is used that includes at least one web having a "z" or through the thickness direction, gradient structure. In these cases, the surface or initial contact concentration of fibers may be conventional, often more coarse, microfibers with a density in the range of from about 0.04 g/cc to about 0.08 g/cc, advantageously within the range of from about 0.04 g/cc to about 0.06 g/cc. Adjacent those fibers is a concentration of higher loft, interbonded microfibers, formed using the process of Example 2, for example, and having a density in the range of from about 0.01 g/cc to about 0.04 g/cc, advantageously in the range of from about 0.02 g/cc to about 0.04 g/cc. Variations include several gradient transitional steps that can be formed as described above using different perturbation conditions. For example, FIG. 1(*a*) illustrates an arrangement of five meltblowing banks producing such a gradient structure. As shown, line 200 includes five separate inline meltblowing devices 202, 204, 206, 208, and 210 with 202 and 210 operating without perturbation to produce conventional meltblown fibers, 204 and 208 operating with perturbation at 200 Hz to produce lower density concentrations of meltblown fibers, and 206 operating at a perturbation level of 75 Hz to produce the most lofty, lowest density meltblown fibers. The resulting material 212 has a cross-section as schematically illustrated in FIG. 1(*b*). As shown, surface fiber concentrations 214, 216 have a generally dense configuration, inner fiber concentrations 218, 220 are less dense, and middle concentration 222 is the most lofty and least dense. In use as an oilsorb, the more dense surface concentrations 214, 216 provide containment, support and abrasion resistance while the gradually increasing loft of the interior concentrations provide storage volume. The result is a highly effective oilsorb product and has an advantage over layered materials of different fiber density since the tendency of interlayer barriers to form is substantially eliminated.

FIGS. 4*a* through 4*d* illustrate various perturbation embodiments useful in accordance with the present invention which utilize alternating air pulses to perturb air flow in the vicinity of the exit of a melt-blown die 59. Each melt-blown embodiment of the present invention includes diametrically opposed plenum/manifolds 22 and 23 and air passages 24 and 25 which lead to a tip of the melt die 59 to create a stream of fibers in a jet stream 26. The function of the present invention is to maintain a steady flow and to superimpose an alternating pressure perturbation on that steady flow near the tip of melt die 59 by alternatingly increasing or reducing the pressure of the manifolds 22 and 23. This technique assures controlled modifications in the gas borne stream of fibers 26 and therefore facilitates regularity of pressure fluctuations in the gas borne stream of fibers. Additionally, the relatively high steady state air flow with respect to perturbation air flow amplitude also serves to prevent the airborne stream of fibers from becoming tangled on air plates 40 and 42. The jet structure air entrainment rate (and therefore quenching rate) and fiber entanglement are thus modified favorably.

Figure 4B:
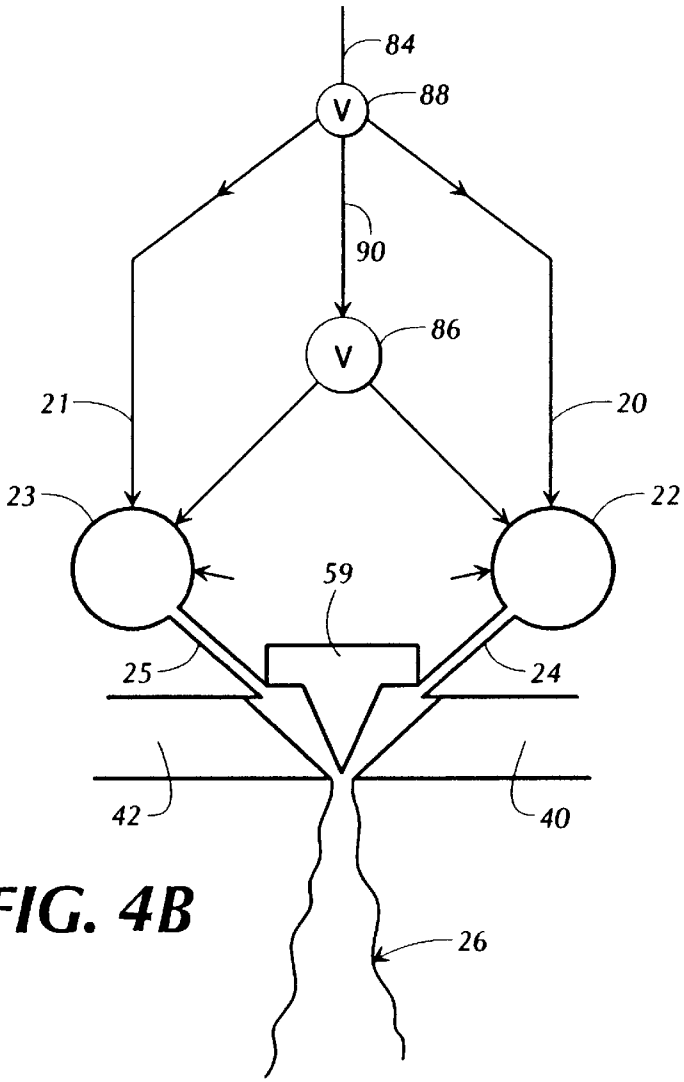
FIGS. 4*a*–4*d* illustrate schematic representations of apparati for producing melt-blown fibers according to the present invention.
Figure 4A:
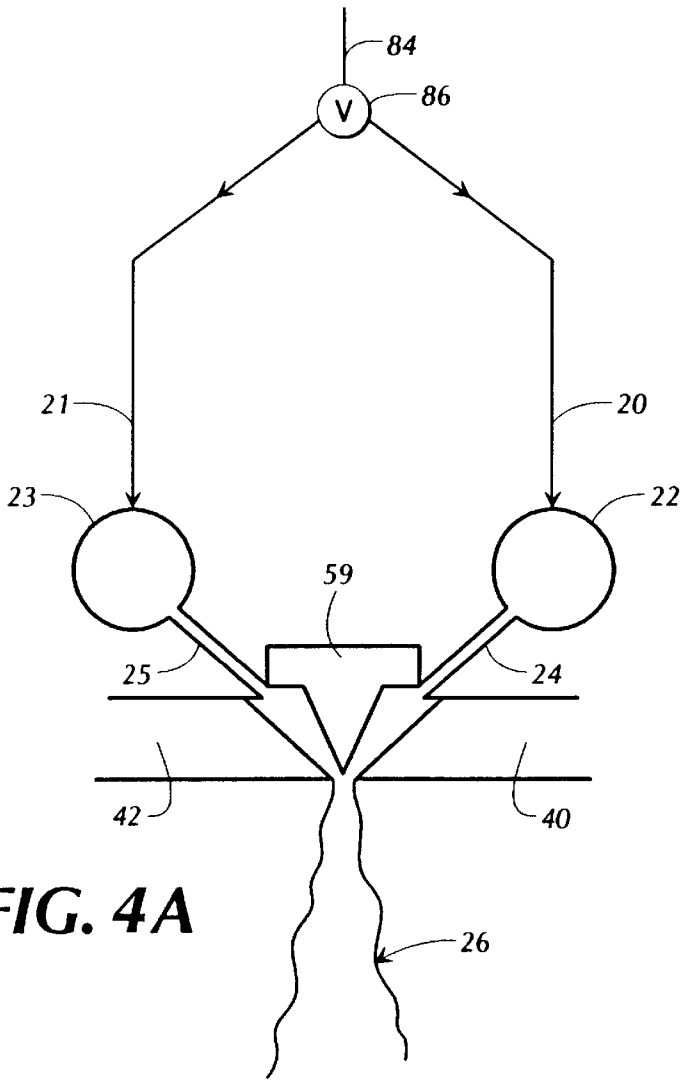
Figure 4D:
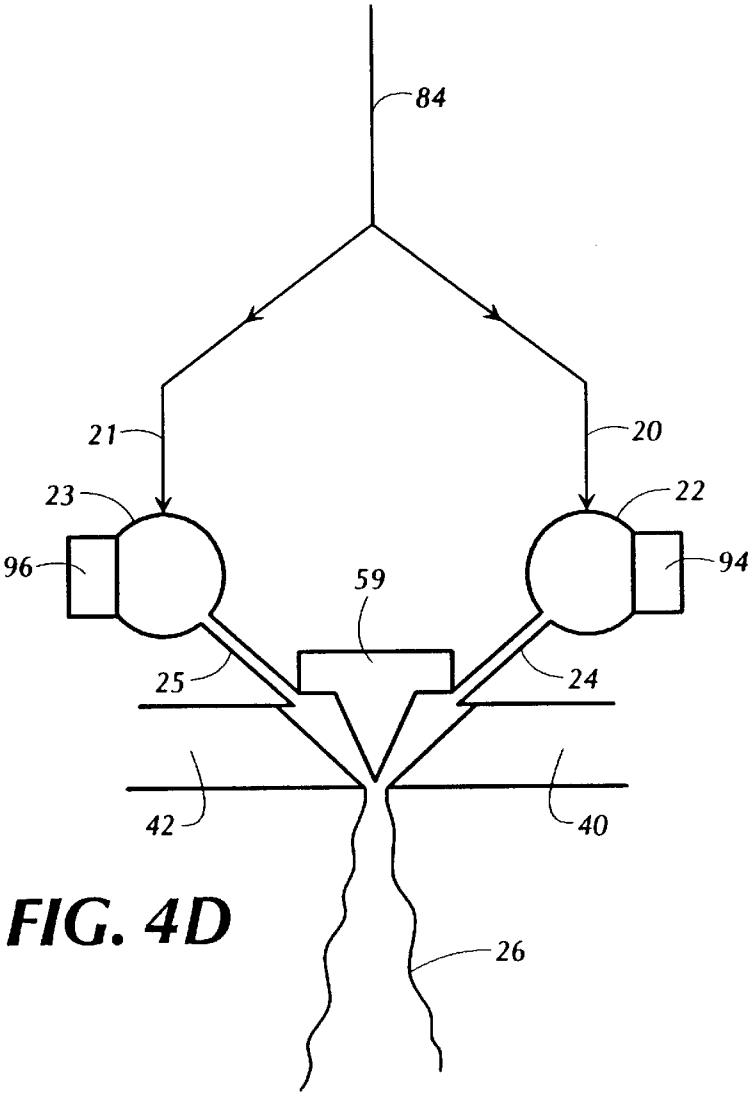
Figure 4C:
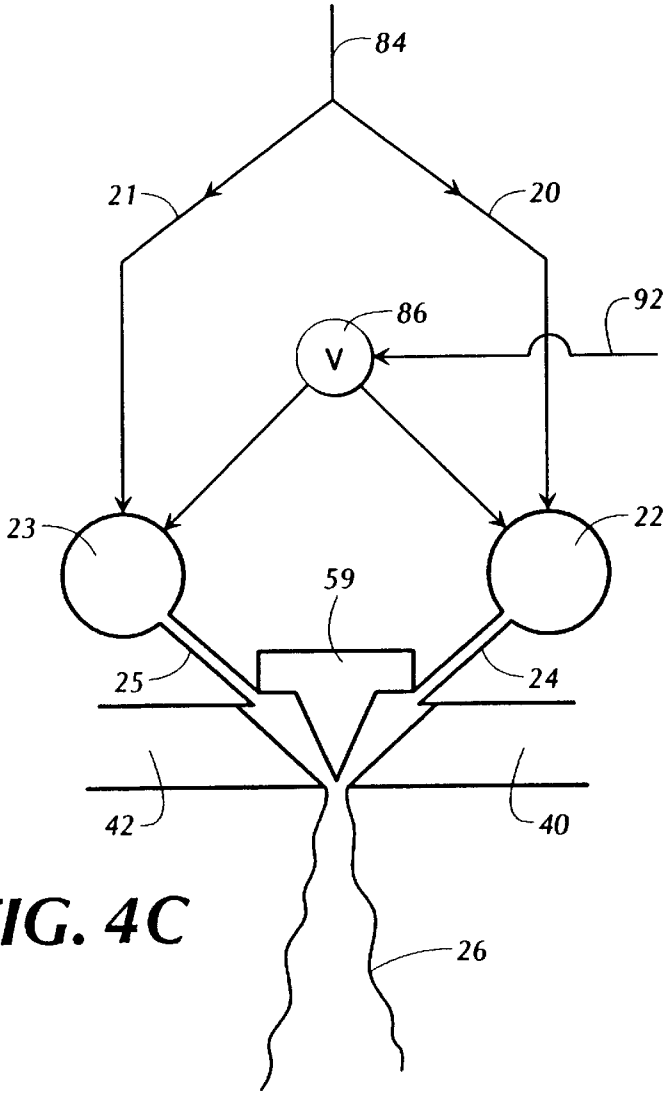
Figure 5A:
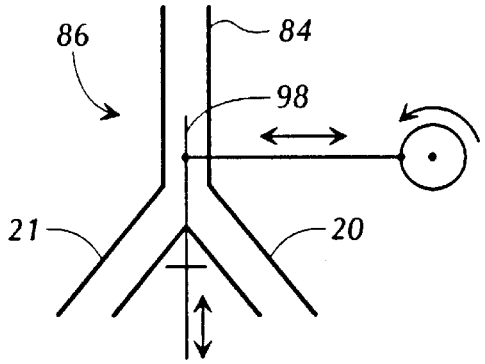
FIGS. 5*a*–5*e* illustrate schematic representations of three-way valve embodiments which may be utilized in accordance with the present invention.

FIGS. 5*a* through 5*d* illustrate a few examples of valves that alternatingly augment the pressure in plenum chambers 22 and 23 shown in FIGS. 4*a*–4*d*. Referring to FIG. 5*a*, perturbation valve 86 is essentially comprised of a bifurcation of main air line 84 into inlet air lines 20 and 21. In the immediate vicinity of the bifurcation, a pliant flapper 98 alternatingly traverses the full or partial width of the bifurcation. This provides a means for alternatingly limiting air flow to one of air inlet lines 20 and 21 thereby superimposing a fluctuation in air pressure in manifolds 22 and 23. Alternatively, an activator may mechanically oscillate the flapper across the bifurcation to produce the appropriate fluctuation in air pressure in plenums 22 and 23. Flapper valve 98 may traverse the bifurcation of mainline 84 in an alternating manner simply by the turbulence of air in mainline 84 using the natural frequency of the flapper. Oscillation frequency of valve 86 as disclosed in FIG. 5*a* may be varied mechanically by an activator which reciprocates the flapper, or by simply adjusting the length of the flapper 98 to change its natural frequency.

Figure 5B:
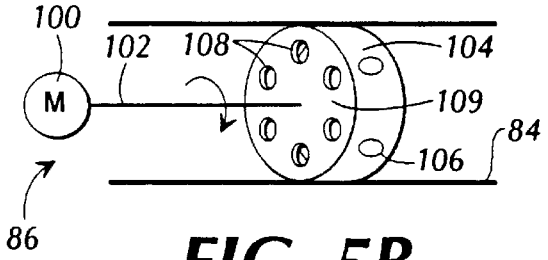

FIG. 5*b* illustrates a second embodiment of the perturbation valve 86. This embodiment may include a motor 100 which rotates a shaft 102. The shaft 102 may be fixed to a rotation plate 109 which has a plurality of apertures 108 disposed thereon. Behind rotation plate 109 is a stationary plate 104 containing a plurality of apertures 106. Both disks may be mounted so that flow is realized through fixed disk openings only when apertures from the rotation plate 109 are aligned with apertures in the stationary plate 104. The apertures on each plate may be arranged such that a steady flow may be periodically augmented when apertures on each plate are aligned. The frequency of the augmented flow may be controlled through a speed control of motor 100.

Figure 5C:
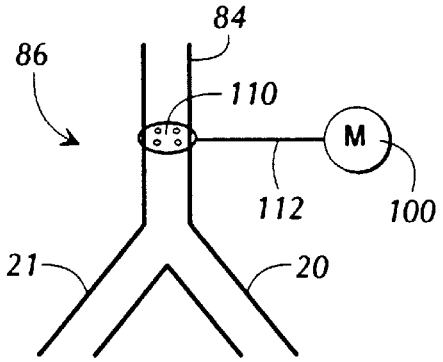

FIG. 5*c* illustrates yet another embodiment of perturbation valve 84. In this embodiment a motor 100 is rotatingly coupled to a shaft 112 which supports a butterfly valve 110 having essentially a slightly smaller cross-section than main air line 84. Turbulence created downstream from rotating butterfly valve 110 may then provide an alternatingly augmented air pressure in air inlet lines 20 and 21 and also in air plenums 22 and 23 to achieve the flow conditions in accordance with the present invention.

Figure 5D:
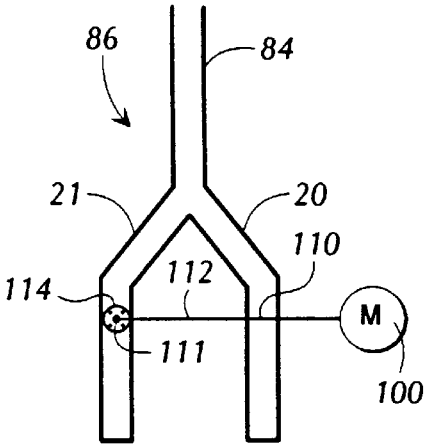

FIG. 5*d* represents yet another embodiment of a perturbation valve 86 in accordance with the present invention. There, a motor 100 is coupled to a shaft 112 and butterfly valves 110 and 114 within inlet air lines 20 and 21 respectively. As is seen from FIG. 5*d*, butterfly valves 110 and 114 are mounted on shaft 112 approximately 90° to each other. Additionally, each of the butterfly valves 110 and 114 may include apertures 111 so as to provide a constant air flow to each of the plenums while alternatingly augmenting pressure in each of the plenums 22 and 23 when the appropriate butterfly valve is in an open position.

Figure 5E:
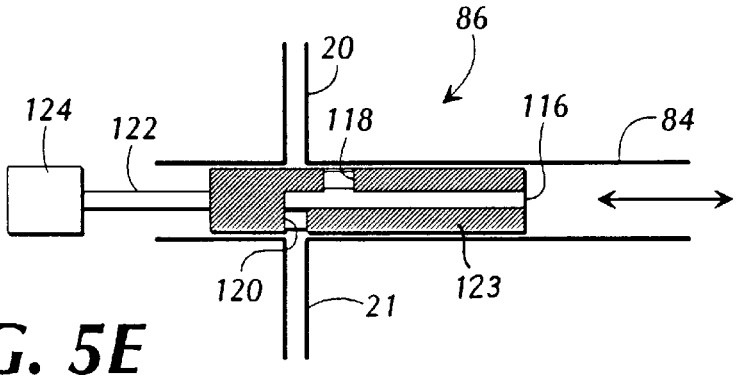

FIG. 5*e* represents still another embodiment of the perturbation valve 86. In this embodiment an actuator 124 is coupled to a shaft 122 which in turn is mounted to a spool 123. Spool 123 includes channels 118 and 120 which communicate with air inlet lines 20 and 21 respectively, depending on the longitudinal position of the spool 123. Each of the channels 118 and 120 is fluidly connected to main channel 116 which is fluidly connected to main air line 84. In this embodiment, perturbation valve 86 may achieve alternatingly augmented air pressures in each of the plenums by reciprocation of rod 122 from actuator 124. Additionally, channels 118 and 120 may simultaneously be connected to main air line 84 while activator 124 reciprocates spool 123 to vary an amount of overlap, and thus air flow restriction, between channels 118 and 120 with lines 20 and 21, respectively, to achieve alternating augmented pressures in the plenum chambers 22 and 23, respectively. Actuator 124 may include any known means for achieving such reciprocation. This may include but is not limited to pneumatic, hydraulic or solenoid means.

Figure 6A:
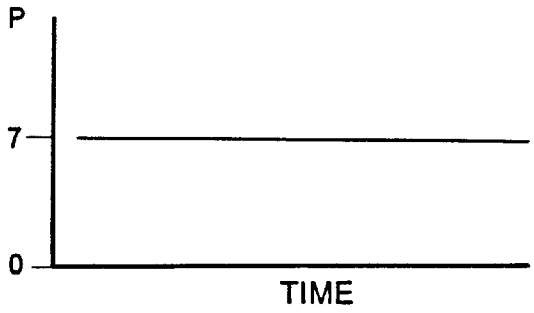
FIG. 6A PRIOR ART
FIGS. 6*a* and 6*d* illustrate plenum pressure as a function of time for a prior art apparatus for producing melt-blown fibers.
Figure 6B:
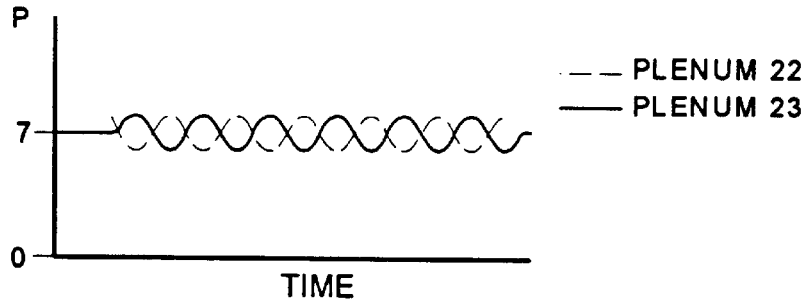
FIGS. 6*b*–6*c* illustrate plenum pressure as a function of time for an apparatus for producing melt-blown fibers in accordance with the present invention.
Figure 6C:
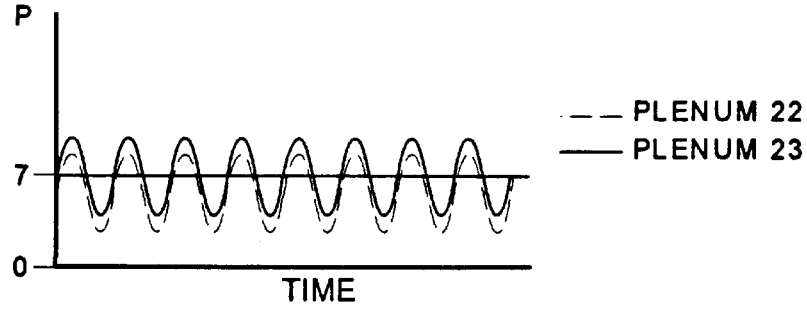
Figure 6D:
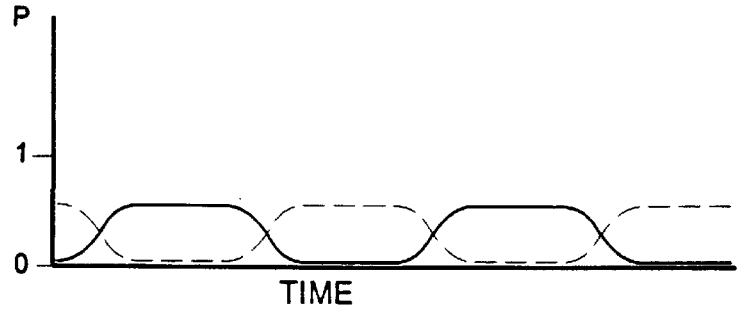
FIG. 6D PRIOR ART

FIGS. 6*a*–6*d* illustrate, respectively, plenum air pressures in both the prior art melt-blown apparatus and in the melt-blown apparatus according to the present invention. As is seen in FIG. 6*a*, a prior art air pressure in the plenum chambers is essentially constant over time whereas in FIGS. 6*b* and 6*c* the air pressure in the plenum chambers is essentially augmented in an oscillatory manner. As an example, the point at which the mean pressure intersects the ordinate can be about 7 psig. FIG. 6*d* illustrates a prior art air pressure in the vicinity of a prior art extrusion die where air is turned on and off. In this case, the mean pressure meets the ordinate at about 0.5 psig, for example. The on/off control of prior art air flow as illustrated in FIG. 6*d* is conducive to die clogging due to the intermittent flow, as explained above. Additionally, the prior art on/off air flow control illustrated in FIG. 6*d* (implemented by Shambaugh) utilizes a lower average pressure, a lower frequency and less pressure amplitude than perturbation of continuous flow. Although the airflow characteristic illustrated in FIG. 6*a* is not conducive to die clogging, no control may be implemented over fiber crimping or web characteristics, since the flow is virtually constant with respect to time.

Perturbation valve 86 may be placed in a multitude of arrangements to achieve the alternatingly augmented flow in plenum chambers 22 and 23 of the melt-blown apparatus according to the present invention. For example, FIG. 4*b* shows another embodiment according to the present invention. In this embodiment, main air line 84 bifurcates constant air flow to inlet air lines 20 and 21 while bleeding an appropriate flow of air to perturbation valve 86 via bleeder valve 90. Therefore, in this embodiment plenum chambers 23 and 22 each includes two inlets. The first inlet introduces essentially constant flow from air inlet lines 20 and 21. The second inlet of each plenum chamber introduces the alternating flow to the chamber, thereby superimposing oscillatory flow on the constant flow from lines 20 and 21. The amount of air bled from bleeder valve 88 will control the amplitude of the pressure augmentation for precise adjustment of fiber characterization, as explained in greater detail below, while perturbation valve 86 controls frequency.

FIG. 4*c* represents yet another embodiment for perturbation useful in the present invention. In this embodiment, main air line 84 bifurcates into air lines 21 and 22 to supply air pressure to plenum chambers 22 and 23. Additionally, an auxiliary air line 92 bifurcates at perturbation valve 86. The perturbation valve 86 then superimposes an alternatingly augmented air pressure onto plenum chambers 22 and 23 to achieve the oscillatory flow conditions in accordance with the present invention. Here, pressure on the air line 92 controls the amplitude of air pressure perturbation, while perturbation valve 86 controls perturbation frequency, as explained above.

FIG. 4*d* represents yet another embodiment of perturbation. In this embodiment, main air line 84 bifurcates into inlet air lines 20 and 21 which lead to plenum chambers 22 and 23 respectively. The alternatingly augmented pressure in plenum chambers 22 and 23 may be provided by transducers 94 and 96 respectively. Transducers 94 and 96 are actuated by means of an electrical signal. For example, the transducers may actually be large speakers which receive an electrical signal to pulsate 180° out of phase in order to provide the alternating augmented pressures in plenum chambers 22 and 23. However, any type of appropriate transducer may create an augmented air flow by using any means of actuation. This may include but is not limited to electromagnetic means, hydraulic means, pneumatic means or mechanical means.

As was discussed previously, all of the described embodiments allow for the precise control of the perturbation frequency and amplitude, preferably without interrupting the operation of the fiber forming machinery. As will be described below, this ability to precisely control the perturbation parameters allows for relatively precise control of the characteristics of the fibers and web formed thereby. Typically, there are a wide variety of fiber parameters and while a particular set of parameters may be desired for making nonwoven material of a particular fiber density, a different set of fiber parameters may be desired for making a different level of fiber density.

Sorbent structures for oil are described, for example, in U.S. Pat. No. 5,364,680 to Cotton which is incorporated herein in its entirety by reference. For oil sorbent applications it is desired to have a microfiber web that is oleophilic and characterized by a bulk in terms of density of no more than about 0.1 g/cc, preferably no more than about 0.06 g/cc. In general, lower densities are preferred but densities below 0.01 g/cc are difficult to handle. Such webs have the ability to soak up and retain oil in an amount of at least about 10 times the web weight, preferably at least about 20 times the web weight. For certain applications it may be desired to provide a treatment with one or more compositions to increase wettability by aqueous liquids. Such treatments are well known and described, for example, in coassigned U.S. Pat. No. 5,057,361 which is incorporated herein in its entirety. Prior attempts to produce such webs by meltblowing techniques, while resulting in useful fine fiber materials, have lacked the desirable bulk, abrasion resistance and absorbency due to the manner in which the air streams applied the still tacky fibers to the forming surface.

Thus, with precise control of the fiber and material characteristics by control of the perturbation characteristics, a great degree of flexibility is possible in the formation of non-woven webs having controlled fiber density properties through the web thickness. This control, in turn, allows for greater efficiency and the ability to design a greater range of materials which may be produced with little interruption of the production process.

One shortcoming of prior art melt-blown equipment is the relative inability to precisely control the diameter of fibers produced thereby. The formation of high sorbency materials with particular characteristics often requires precise control over the diameter of the fibers used to form the non-woven web. With the perturbation technique of the present invention, high sorbency nonwovens are provided with much less variation in fiber diameter than was previously possible with prior art techniques.

Figure 7:
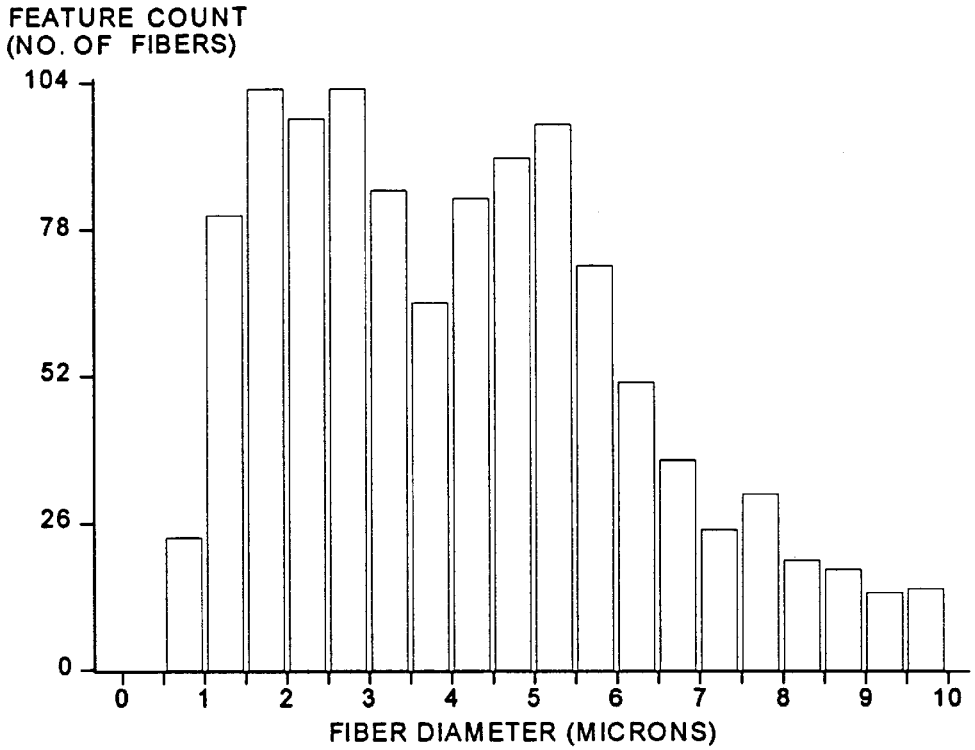
PRIOR ART FIG. 7
FIG. 7 illustrates fiber diameter distribution for melt-blown fibers manufactured in accordance with the prior art.
Figure 8:
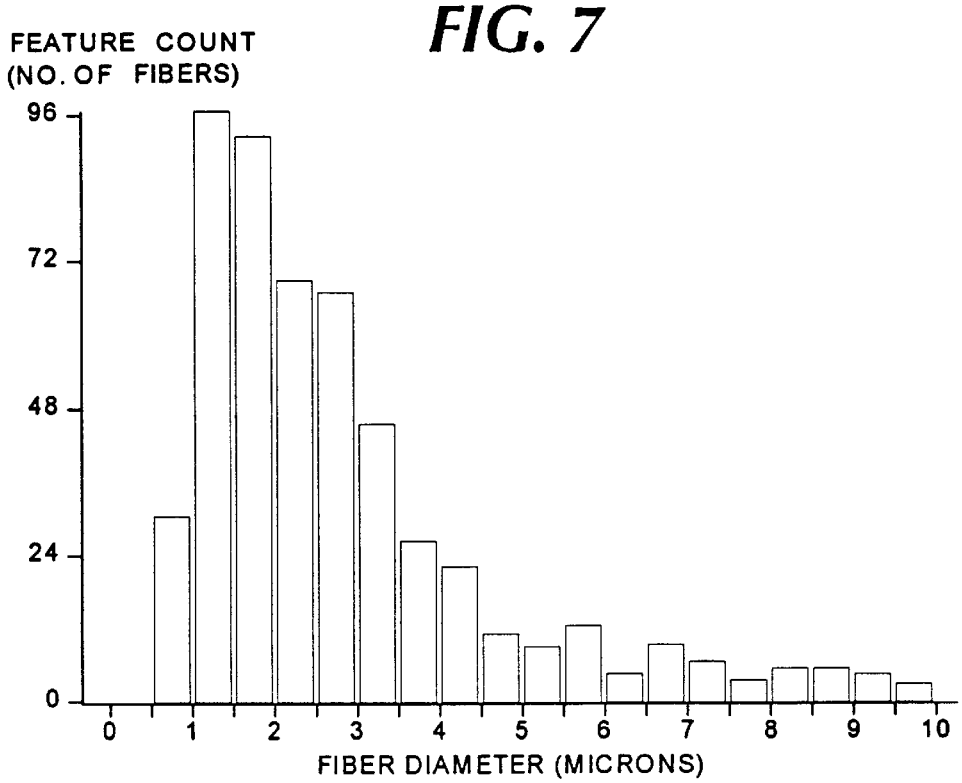
FIG. 8 illustrates fiber diameter distribution for melt-blown fibers manufactured in accordance with the present invention.

FIGS. 7 and 8 illustrate fiber diameter distribution for samples taken from prior art melt-blown techniques and the melt-blown fiber producing technique according to the melt-blown apparatus embodiment of FIG. 4*c*. FIG. 7 shows a diameter distribution in accordance with the prior art. FIG. 8 represents a fiber diameter distribution chart for melt-blown fibers made using perturbation. The fiber distribution in FIG. 8 illustrates a fiber diameter sample which has a distribution that is centered on a peak between about 1 and 2 microns and predominantly within a range of about 4, preferably about 3 microns in variance. Here, the narrow band of fiber distribution achieved by the perturbation method and apparatus illustrates the great extent to which fiber diameter may be controlled by only varying perturbation frequency or amplitude.

Figure 9:
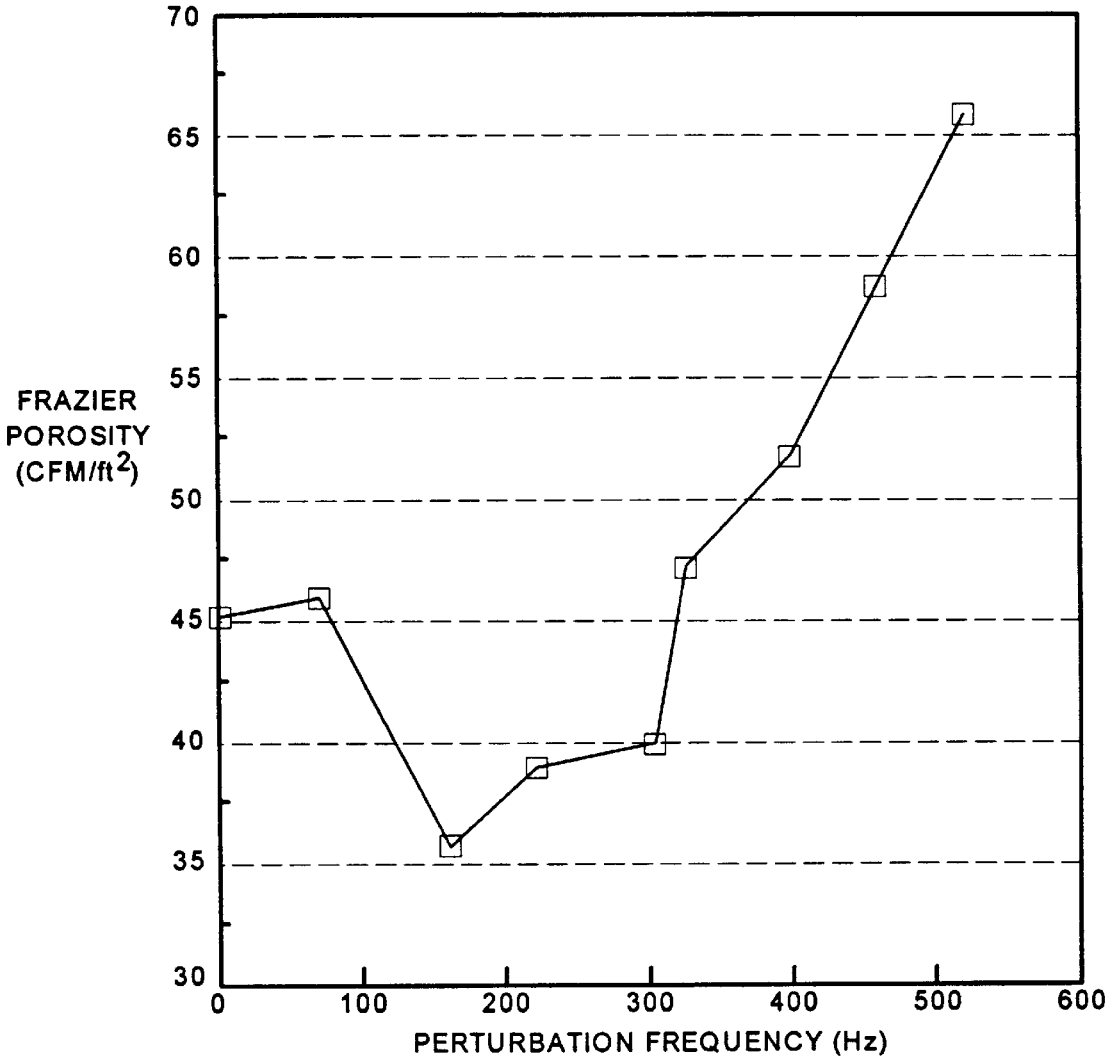
FIG. 9 illustrates Frazier porosity as a function of perturbation frequency for a melt-blown non-woven web manufactured in accordance with the present invention.

FIG. 9 represents the Frazier porosity of a nonwoven melt-blown web as a function of perturbation frequency in the plenum chambers 22 and 23. The Frazier Porosity is a standard measure in the non-woven web art of the rate of airflow per square foot through the material and is thus a measure of the permeability of the material (units are cubic feet per square foot per minute). For all samples the procedure used to determine Frazier air permeability was conducted in accordance with the specifications of method 5450, Federal Test Methods Standard No. 191 A, except that the specimen sizes were 8 inches by 8 inches rather than 7 inches by 7 inches. The larger size made it possible to ensure that all sides of the specimen extended well beyond the retaining ring and facilitated clamping of the specimen securely and evenly across the orifice.

As is illustrated in FIG. 9, the Frazier porosity generally falls first to a minimum and then increases with perturbation frequency from a steady state to approximately 500 hertz. Thus, one can observe that to make a material with a desired Frazier porosity, it is only necessary to vary the oscillation frequency (and/or the amplitude). With prior art techniques, changes in porosity often required changes to the die or starting materials or the duplication of machinery. Thus, with the present techniques, it is possible to easily change the porosity of a material once a run is completed; it is only necessary to adjust the perturbation frequency (or amplitude), which can easily be done with simple controls and without stopping production. Therefore, each bank of the melt-blowing apparati according to the present invention may quickly and easily manufacture sorbency materials of a desired porosity by simply changing perturbation frequency.

EXAMPLES

The following examples provide a basis for demonstrating the advantages of the present invention over the prior art in the production of melt-blown and coform webs and materials. These examples are provided solely for the purpose of illustrating how the methods of the present invention may be implemented and should not be interpreted as limiting the scope of the invention as set forth in the claims.

Example 1

Process Condition

Die Tip Geometry: Recessed

Die Width=20"

Gap=0.090"

30 hpi

Primary Airflow: Heated (≈608° F. in heater)

488 scfm

Pressure $P_T$=6.6 psig

Auxiliary Airflow: Unheated (ambient air temp.)

60 scfm

Inlet Pressure=20 psig

Polymer: Copolymer of butylene and propylene polypropylene*—79% polybutylene—20% blue pigment—01%

*800 MFR polypropylene coated with peroxide—final MFR≈1500

Polymer Throughput: 0.5 GHM

Melt Temperature: 470° F.

Perturbation Frequency: 0 Hz, 156 Hz, 462 Hz

Basis Weight: 0.54 oz/yd$^2$

Forming Height: 10"

Test Results

TABLE 1-1

| Perturbation Frequency | 0 Hz | 156 Hz | 462 Hz |
|---|---|---|---|
| Frazier Porosity (cfm/ft$^2$) | 45.18 | 35.70 | 65.89 |

In this example, the melt-blown process was configured as described above and corresponds to the embodiment shown in FIG. 4*c,* in which the primary airflow is supplemented with an auxiliary airflow. In the example, the unit hpi characterizes the number of holes per inch present in the die across the web former. $P_T$ is defined as the total pressure measured in a stagnant area of the primary manifold. GHM is defined as the flow rate in grams per hole per minute; thus, the GHM unit defines the amount, by weight, of polymer flowing through each hole of the melt-blown die per minute. As discussed above, Frazier Porosity is a measure of the permeability of the material (units are cubic feet per minute per square foot). The hydrohead, measured as the height of a column of water supported by the web prior to permeation of the water into the web, measures the liquid barrier qualities of the web.

The above configuration and results provide a baseline comparison of a typical melt-blown production run with no air perturbation (a frequency of perturbation of 0 Hz) with runs conducted with perturbation frequencies of 156 and 462 Hz.

Figure 11:
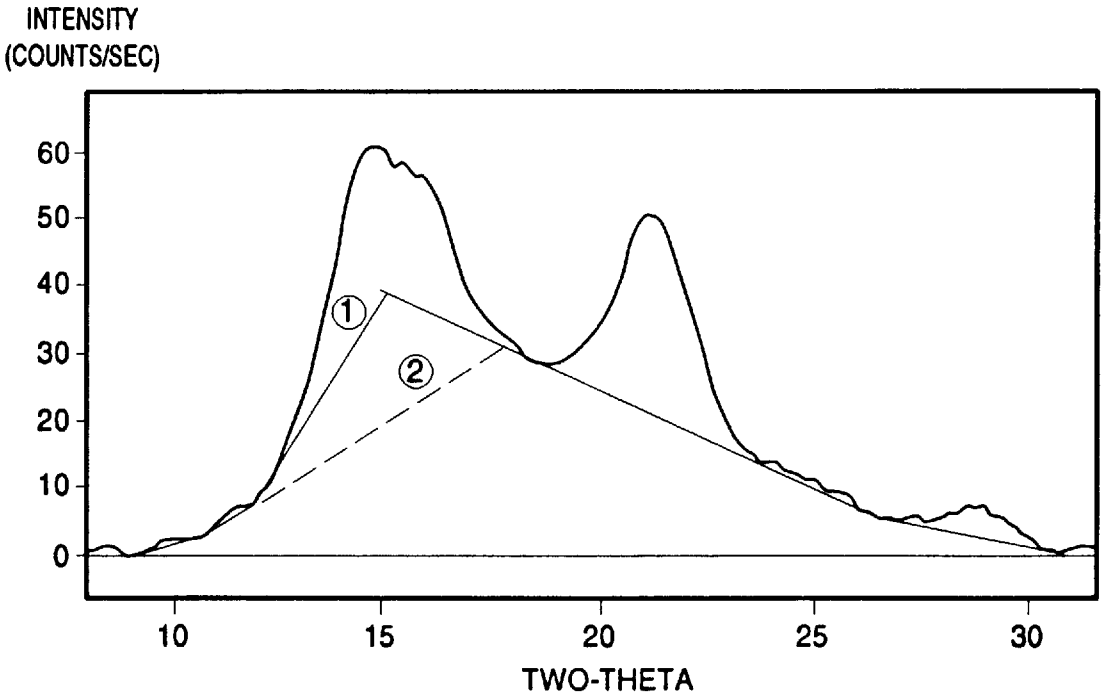
Figure 12:
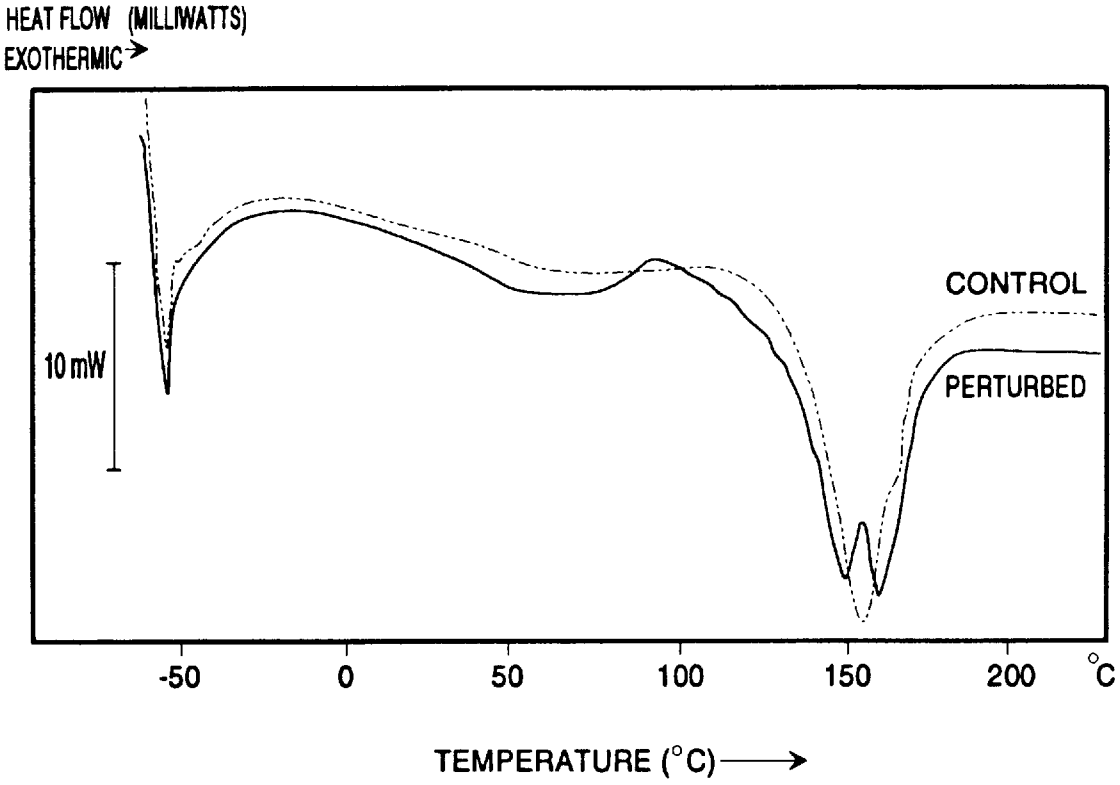
FIG. 12 is a DSC (Differential Scanning Calorimetry) comparing the calorimetric characteristics of a prior art meltblown fiber and a perturbed fiber made as described herein.

The change in barrier properties with respect to change in perturbation frequency is also demonstrated in FIGS. 11 and 12 (for different process conditions from those of Example 1). As FIG. 9 shows, there is an initial drop in Frazier Porosity as the process is changed from no perturbation to a perturbation frequency between 1 and 200 Hz. As the perturbation frequency is increased above about 200 Hz, the Frazier Porosity increases, until the original 0 Hz Frazier Porosity is exceeded between about 300 to 400 Hz. Above 400 Hz, the Frazier Porosity increases relatively steeply with increasing perturbation frequency. Thus, as these Figures demonstrate, with no variation in the basic process conditions such as polymer type, flow conditions, die geometry, aside from a simple change in the frequency of perturbation of the airflow, a wide variety of different web materials can be made having desired porosity properties. For example, by merely setting the perturbation frequency in the 100 to 200 Hz range, with all of the other process conditions remaining unchanged, a less porous material can be made. Then, if greater porosity material was desired within the web, the only process change necessary would be an increase in the perturbation frequency of a central bank of the line, which could be accomplished with a simple control and without necessitating the interruption of the production line. In prior art techniques, alteration of the production run barrier properties may require substantial changes in the process conditions, thereby requiring a production line shut-down to make the changes. In actuality, such changes are not typically made on a given prior art machine; multiple machines typically produce a single type of web material (or an extremely narrow range of materials) having desired properties.

Example 2

Process Conditions

Die Tip Geometry: Recessed

Die Width=20"

Gap=0.090"

30 hpi

Primary Airflow: Heated (≈608° F. in heater)

317 scfm

Pressure $P_T$=2.6 psig

Auxiliary Airflow: Unheated (ambient air temp.)

80 scfm

Inlet Pressure=20 psig

Polymer: High MFR PP*

*e.g. 800 MFR polypropylene coated with peroxide final MFR≈1500

Polymer Throughput: 0.5 GHM

Melt Temperature: 470° F.

Perturbation Frequency: 0 Hz (control), 70 Hz

Basis Weight: 5 oz/yd$^2$

Forming Height: 10"

Test Results

In this example the bulk of the web made using a 70 Hz perturbation frequency was compared to a control web (0 Hz perturbation frequency).

Control—0.072" (thickness)

70 Hz—0.103"

Thus, it can be seen that using a modest 70 Hz perturbation frequency results in a 43% increase in bulk over the prior art. Increased bulk is often desired in the final web or material because the increased bulk often provides for better feel and absorbency.

Even higher bulk may be obtained if desired using a water quench as described in U.S. Pat. No. 3,959,421 to Weber which is incorporated herein by reference, the operation of which is enhanced by perturbing in accordance with the invention.

Furthermore, with respect to desired texture or appearance, the use of the perturbation techniques of the present invention allows for custom texture or appearance control. Thus, to the extent such bulk and crimp are desired, the techniques of the present invention allow for added control and variety in production of various types of webs having such characteristics.

Examples 2A–2I

Process Conditions

Die Tip Geometry: Die Width 100 in 30 hpi

Primary Airflow: 1500–1800 scfm (general range)

2A 1800 scfm

2B 1750 scfm 2C 1750 scfm (per bank)

2D 1750 scfm (per bank)

2E 1800 scfm 2F 1800 scfm 2G 1600 scfm 2H 1500 scfm 2I 1750 scfm

Primary Air Temp: 575° F.–625° F. (general range)

2A 625° F.

2B 600° F.

2C 600° F. (per bank)

2D 600° F. (per bank)

2E 625° F.

2F 575° F.

2G 575° F.

2H 575° F.

2I 600° F.

Perturbation Frequency: 75 Hz–200 Hz

Polymer: PF-015—polypropylene

Throughput: 4.8PIH

Melt Temperature: 600° F.

This series of examples illustrates the ranges of high bulk and oil capacity results obtainable with perturbation of meltblown webs which can be used as multibank operations in accordance with the present invention. Using an arrangement as shown in FIG. 6B, meltblown webs were produced using the processing conditions shown. These materials were tested for bulk and oil capacity, and in addition, the roll samples were tested for oil absorption rate.

Oil Absorption Tests

Oil absorption test results were obtained using a test procedure based on ASTM D 1117-5.3. Four square inch samples of fabric were weighed and submerged in a pan containing oil to be tested (white mineral oil, +30 Saybolt color, NF grade, 80–90 S.U. viscosity in the case of roll samples and 10W40 motor oil in the case of hand samples) for two minutes. The samples were then hung to dry (20 minutes in the case of roll samples and 1 minute in the case of hand samples). The samples were weighed again, and the difference calculated as the oil capacity.

The variation in results for bulk and oil capacity between the rolled samples and hand samples results from compression in the rolled configuration. In both cases the improvement of the invention is apparent. Since the control was not perturbed, it was compressed as formed and was relatively unaffected by being formed into a roll.

Oil Rate Tests

Oil rate results were obtained in accordance with TAPPI Standard Method T 432 su-72 with the following changes:

To measure oil absorbency rate, 0.1 ml of white mineral oil is used as the test liquid.

Three separate drops are timed on each specimen, rather than just one drop.

Five specimens are tested from each sample rather than ten, i.e. a total of 15 drops is timed for each sample instead of ten drops.

Oilsorb Data

TABLE 2-1 roll samples

| Example | Perturbation Conditions | Bulk inches | Density gm/cm$^3$ | Oil Capacity g/g | Oil Rate sec |
|---|---|---|---|---|---|
| 2A Control 1 Bank | 0 Hz | 0.1294 | 0.057 | 11.91 (18.21*) | 1.847 |
| 2B 1 Bank | 200 Hz | 0.1678 | 0.047 | 12.84 | 1.673 |
| 2C 2 Bank | 200 Hz/150 Hz | 0.1537 | 0.050 | 11.25 | 1.805 |
| 2D Control 2 Bank | 0 Hz | 0.0987 | 0.075 | 9.79 | 2.200 |

*Test method for hand samples-Table 2-2

TABLE 2-2 hand samples

| Example | Perturbation Conditions | BW oz/yd$^2$ | Bulk inches | Oil Capacity g/g | Comments |
|---|---|---|---|---|---|
| 2E | (75 Hz) | 6.10 | 0.210 | 26.08 | 1 Bank |
| 2F | (150 Hz) | 5.90 | 0.159 | 21.54 | 1 Bank |
| 2G | (150 Hz) | 5.80 | 0.136 | 19.43 | 1 Bank |
| 2H | (75 Hz) | 5.75 | 0.143 | 21.75 | 1 Bank |
| 2I | (200 Hz) | 5.91 | 0.155 | 23.15 | 1 Bank |

Example 3

Process Conditions

Die Tip Geometry: Recessed

Gap=0.090"

30 hpi

Primary Airflow: Heated (≈608° F. in heater)

426 scfm

Pressure $P_T$=5 psig

Auxiliary Airflow: Unheated (ambient air temp.)

80 scfm

Inlet Pressure=20 psig

Polymer: High MFR PP*, 1% Blue pigment

*e.g. 800 MFR polypropylene coated with peroxide final MFR≈1500

Polymer Throughput: 0.6 GHM

Melt Temperature: 480° F.

Perturbation Frequency: 0 Hz (control), 192 Hz, 436 Hz

Basis Weight: 0.54 oz/yd$^2$

Forming Height: 10"

Test Results

Strength

TABLE 3-1

| Perturbation Frequency | 0 Hz | 192 Hz | 436 Hz |
|---|---|---|---|
| MD Peak Load (lbs) | 1.989 | 2.624 | 2.581 |
| MD Elongation (in) | 0.145 | 0.119 | 0.087 |
| CD Peak Load (lbs) | 1.597 | 1.322 | 1.743 |
| CD Elongation (in) | 0.202 | 0.212 | 0.135 |

As can be seen from Table 3-1, the machine direction strength increases for runs in which the perturbation frequency is greater than 0 Hz. In the production runs of Example 3, the direction of perturbation was generally parallel to the machine direction (MD). Applicants believe that the increased strength in MD is due to more controlled and regular overlap in the lay-down of the web on the substrate as the fibers oscillate as a result of the perturbation. It is applicants' belief that increases in CD strength can be achieved by varying the angle of the perturbation relative to the MD. Thus, by having the perturbation occur at some angle between parallel to MD and perpendicular to MD, CD strength can be improved as well as MD strength.

Barrier

TABLE 3-2

| Perturbation Frequency | 0 Hz | 192 Hz |
|---|---|---|
| Frazier Porosity (cfm/ft$^2$) | 31.5 | 22.3 |
| Hydrohead (cm of $H_2O$) | 90.8 | 121.6 |
| Equiv. Pore Diameter ($\mu$ m) | 13.2 | 10.8 |

As Table 3-2 and FIG. 9 demonstrate, and as was demonstrated in Example 1, at relatively low perturbation frequencies (between about 100 to 200 Hz) the barrier properties of a web produced thereby increase. This result is explained by the measured Equivalent Circular Pore Diameter in the 0 Hz case and the 192 Hz case. As is shown in Table 3-2, the pore size for web material produced using a 192 Hz perturbation frequency is 2.4 microns less than that for a material produced with no perturbation. Thus, since the pores in the material are smaller, the permeability of the material is less and the barrier properties are greater.

Example 4

Process Conditions

Die Tip Geometry: Recessed

Die Width=20"

Gap=0.090"

30 hpi

Primary Airflow: Heated (≈608° F. in heater)

422 scfm

Pressure $P_1$=5 psig

Auxiliary Airflow: unheated (ambient air temp.)

40 scfm

Inlet Pressure=15 psig

Polymer: Copolymer of butylene and propylene polypropylene*—79% polybutylene—20% blue pigment—01%

*800 MFR polypropylene coated with peroxide—final MFR≈1500

Polymer Throughput: 0.6 GHM

Melt Temperature: 471° F.

Perturbation Frequency: 0–463 Hz

Basis Weight: 0.8 oz/yd$^2$

Forming Height: 12"

Test Results

Barrier

TABLE 4-1

| Perturbation Frequency | 0 Hz | 305 Hz | 463 Hz |
|---|---|---|---|
| Frazier Porosity (cfm/ft$^2$) | 46.27 | 26.85 | 59.34 |

Once again, it can be seen that the porosity of the web material initially decreases when the airflow is perturbed. However, as the perturbation frequency increases, the porosity also increases. The results in Example 4 agree with the other barrier property results from the other examples and with the results reported in FIG. 9.

Although the above referenced examples utilize a polypropylene or mixture of high melt flow polypropylene and polybutylene resins for non-woven web production, a multitude of thermoplastic resins and elastomers may be utilized to create melt-blown non-woven webs in accordance with the present invention. Since it is the structure of the web of the present invention which is largely responsible for the improvements obtained, the raw materials used may be selected from a wide variety. For example, and without limiting the generality of the foregoing, thermoplastic polymers such as polyolefins including polyethylene, polypropylene as well as polystyrene may be used. Additionally, polyesters may be used including polyethylene, terepthalate and polyamides including nylons. While the web is not necessarily elastic, it is not intended to exclude elastic compositions. Compatible blends of any of the foregoing may also be used. In addition, additives such as processing aids, wetting agents, nucleating agents, compatibilizers, wax, fillers, and the like may be incorporated in amounts consistent with the fiber forming process used to achieve desired results. Other fiber or filament forming materials will suggest themselves to those of ordinary skill in the art. It is only essential that the composition be capable of spinning into filaments or fibers of some form that can be deposited on a forming surface. Since many of these polymers are hydrophobic, if a wettable surface is desired, known compatible surfactants may be added to the polymer as is well-known to those skilled in the art. Such surfactants include, by way of example and not limitation, anionic and nonionic surfactants such as sodium diakylsulfosuccinate (Aerosol OT available from American Cyanamid or Triton X-100 available from Rohm & Haas). The amount of surfactant additive will depend on the desired end use as will also be apparent to those skilled in this art. Other additives such as pigments, fillers, stabilizers, compatibilizers and the like may also be incorporated. Further discussion of the use of such additives may be had by reference to, for example, U.S. Pat. No. 4,374,888 issued to Bornslaeger on Feb. 22, 1983, and U.S. Pat. No. 4,070,218 issued to Weber on Jan. 24, 1978.

Additionally, a multitude of die configurations and die cross-sections may be utilized to create melt-blown non-woven webs in accordance with the present invention. For example orifice diameters of about 0.014 inch at a range of about 20 to 50 holes per inch (hpi) are preferred, however, virtually any appropriate orifice diameter may be utilized. Additionally, star-shaped, elliptical, circular, square, triangular, or virtually, any other geometrical shape for the cross-section of an orifice may be utilized for melt-blown non-woven webs.

Coform Applications

Applicants hereby incorporates by reference U.S. Pat. No. 4,100,324, issued to Anderson et al. on Jul. 11, 1978 which discloses coform methods of polymer processing by combining separate polymer and additive streams into a single deposition stream in forming non-woven webs. Additionally, applicant hereby incorporates by reference U.S. Pat. No. 4,818,464, issued to Lau on Apr. 4, 1989 which discloses the introduction of super absorbent material as well as pulp, cellulose, or staple fibers through a centralized chute in an extrusion die for combination with resin fibers in a non-woven web. Through the chute pulp, staple fibers, or other material may be added to vary the characteristics of the resulting web. Since any of the above described techniques to vary the airflow around a melt-blown die may be used in the coform technique, specific descriptions of all of the valving techniques will not be repeated. However, it will be apparent to one skilled in the art, that to vary the four air flows present in the coform die, the equipment used to control the perturbation of the air flows will have to be doubled.

In the coform technique, there are a variety of possible perturbation combinations. The most basic is to perturb each side of a given die just as described above with respect to the melt-blown techniques. It should be readily apparent that with four air flows as described in above referenced U.S. Pat. No. 4,818,464, many perturbation combinations are possible, all of which are within the scope of the present invention. For example, a centralized chute may be located between the two centralized air flows for introducing pulp or cellulose fibers and particulates. Such a centralized location facilitates integration of the pulp into the non-woven web and results in consistent pulp distribution in the web.

Example 5

As described above, coform materials are essentially made in the same manner as melt-blown materials with the addition of an air stream for incorporating additional fibers or particles into the web, for example, using a second die or adding fibers or particles to the exit fiber stream. In the former arrangement, there are two airflows around each die, for a total of four air flows, which may be perturbed as described above. Additionally, there is typically a gap between the two dies through which pulp or other material may be added to the fibers produced and incorporated into the web being formed. The following example utilizes such a coform-form head, but otherwise, with respect to the airflow perturbation, conforms to the previous description of the melt-blown process.

Process Conditions

Die Tip Geometry: Recessed
Gap=0.070"
Die Width=20"
Primary Air Flow: 350 scfm per bank (20" bank)
Primary Air Temperature: 510° F.
Auxiliary Air Flow: 40 scfm per MB bank
Polymer: PF-015 (polypropylene)
Polymer Ratio: 65/35
Basis Weight: 75 gsm (2.2 osy)

Test Results

TABLE 5-1

| Perturbation Frequency | 0 Hz | 67 Hz | 208 Hz | 320 Hz |
|---|---|---|---|---|
| MD Peak Load | 1.578 | 1.501 | 1.67 | 2.355 |
| MD Elongation (%) | 23.86 | 22.48 | 24.21 | 20.23 |
| CD Peak Load | 0.729 | 0.723 | 0.759 | 0.727 |
| CD Elongation (%) | 49.75 | 52.46 | 58.08 | 71.23 |

From Table 5-1, it can be seen that the results generally agree with those shown in the melt-blown examples. Generally, with increasing perturbation frequency, aligned along the MD, MD strength increased while CD strength remains about the same. Thus, this example shows that the techniques previously described can be applied to coform-forming technology to achieve the process and material control by simple adjustment of the perturbation frequency in the same manner as they were applied to the melt-blown process.

Figure 10:
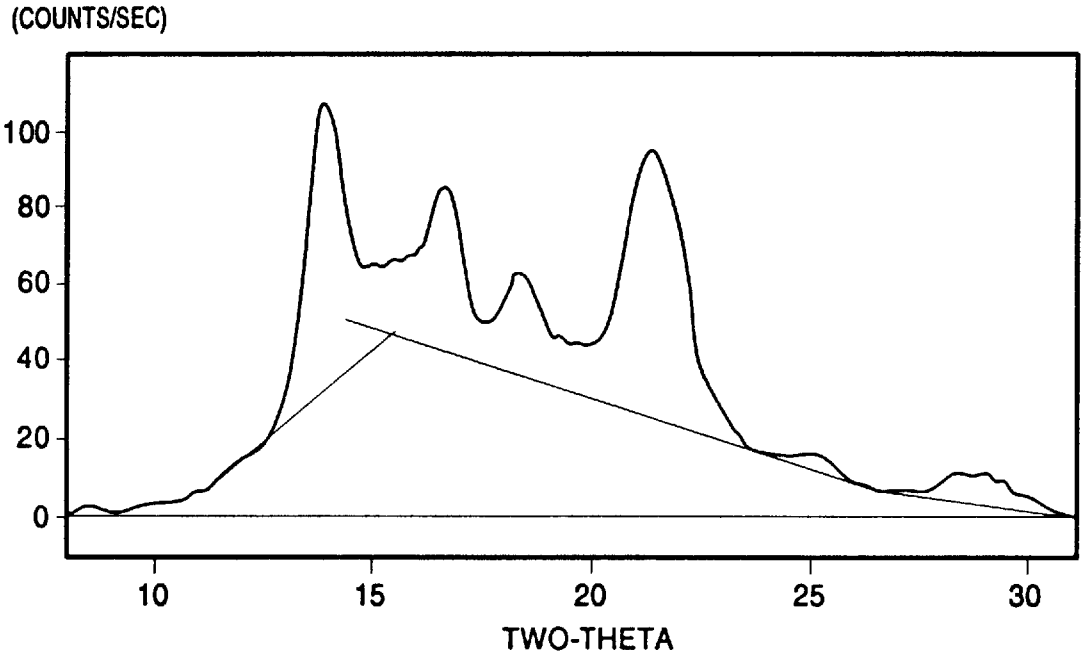
FIGS. 10 and 11 are X-Ray Diffraction Scans of a prior art meltblown fiber and a perturbed fiber made as described herein.

As is seen from the above Examples 1–5 of meltblown and coform non-wovens made in accordance with the present invention, the perturbation techniques allow for the formation of a non-woven webs of various characteristics with relatively simple adjustments to process controls and, in particular, highly improved oil sorbent meltblown and coform webs. While some of the differences can be attributed to the lay-down of the fibers on the forming surface, preliminary investigation indicates that the perturbation techniques also result in fundamental changes to the fibers formed thereby. Referring now to FIGS. 10 and 11, there are shown X-Ray diffraction scans of a meltblown fiber made according to prior art techniques (FIG. 10) and a meltblown fiber made using perturbation (FIG. 11) both otherwise under identical processing conditions and polymer type. As can be seen from comparison of FIGS. 10 and 11, the X-Ray scan of the meltblown fiber made with perturbation has two peaks, while that of the prior art meltblown fiber has several peaks. It is believed that the differences observed in FIG. 11 result from the presence of smaller crystallites in the fiber, which possibly result from better quenching of the fiber during formation. In summary, these X-Ray diffraction scans indicate that the fibers made with perturbation are more amorphous than prior art fibers and may have a broader bonding window than fibers made in accordance with prior art techniques.

Additional evidence of the believed characteristic differences between fiber made with perturbation for use with the present invention and those made in accordance with the prior art are shown in FIG. 12. FIG. 12 is a graph showing the results of a Differential Scanning Calorimetry (DSC) tests conducted on a prior art meltblown fiber (indicated by the dashed line on the graph) and with a fiber made in accordance with the present techniques (the solid line). The test basically observes the absorbance or emission of heat from the sample while the sample is heated. As can be seen from FIG. 12, the DSC scan of the prior art fiber is significantly different from that of the present fiber. A comparison of DSC scans shows two main features in the present fiber that do not appear in the prior art fiber: (1) heat is given off from 80°–110° C. (apparent exotherm) and (2) a double melting peak. It is believed that these DSC results confirm that the perturbation formation techniques produce fibers having significant differences from fibers produced with prior art techniques. Once again, it is believed that these differences relate to crystalline structure and quenching of the fiber during formation.

While preferred embodiments of the present invention have been described in the foregoing detailed description, the invention is capable of numerous modifications, substitutions, additions and deletions from the embodiments described above without departing from the scope of the following claims.

What is claimed is:

1. A high bulk nonwoven sorbent fabric comprising an array of interbonded microfibers having a fiber density gradient across the web thickness.

2. The sorbent fabric of claim 1 having an oil capacity of at least about 20 g/g.

3. The sorbent fabric of claim 2 comprising polyolefin microfibers.

4. The sorbent fabric of claim 3 comprising microfibers of a propylene polymer.

5. The sorbent fabric of claim 4 having an oil rate of no more than about 2 sec.

6. The sorbent fabric of claim 4 also comprising a treatment that increases the aqueous wettability of said fabric.

7. The sorbent fabric of claim 5 also comprising a treatment that increases the aqueous wettability of said fabric.

8. The sorbent fabric of claim 6 wherein said wettability treatment comprises a surfactant.

9. The sorbent fabric of claim 7 wherein said wettability treatment comprises a surfactant.

10. The sorbent fabric of claim 1 also comprising fibers or particles distributed within said microfiber array.

11. A high bulk nonwoven sorbent fabric comprising an array of thermoplastic polyolefin microfibers formed by multi-bank meltblowing under conditions where said microfibers are perturbed to different degrees in separate banks to produce a fiber density gradient across the fabric thickness.

12. The sorbent fabric of claim 11 wherein said polyolefin comprises a propylene polymer.

13. The sorbent fabric of claim 12 further comprising fibers or particles coformed within said array.

14. The sorbent fabric of claim 11 wherein the oil capacity is at least 20 g/g and the oil rate is no more than about 2 sec.

15. The sorbent fabric of claim 12 wherein the oil capacity is at least 20 g/g and the oil rate is no more than about 2 sec.

16. The sorbent fabric of claim 12 also comprising a treatment that increases the aqueous wettability of said fabric.

17. An oilsorb product comprising an array of meltblown propylene polymer microfibers formed by multi-bank meltblowing under conditions where said microfibers are perturbed to different degrees in separate banks to produce a fiber density gradient across the fabric thickness.

18. An oilsorb product according to claim 17 wherein said meltblowing conditions include a water quench.

19. An oilsorb product according to claim 17 also comprising reclaim polymer.

* * * * *